US011753271B2

(12) United States Patent
Higgins

(10) Patent No.: US 11,753,271 B2
(45) Date of Patent: Sep. 12, 2023

(54) COLLAPSIBLE/POP-UP REEL AND METHOD OF MAKING SAME

(71) Applicant: Vail Industries, Inc., Navarre, OH (US)

(72) Inventor: James T. Higgins, Navarre, OH (US)

(73) Assignee: Vail Industries, Inc., Navarre, OH (US)

( * ) Notice: Subject to any disclaimer, the term of this patent is extended or adjusted under 35 U.S.C. 154(b) by 0 days.

(21) Appl. No.: 17/226,174

(22) Filed: Apr. 9, 2021

(65) Prior Publication Data

US 2021/0316957 A1 Oct. 14, 2021

Related U.S. Application Data

(60) Provisional application No. 63/008,051, filed on Apr. 10, 2020.

(51) Int. Cl.
*B65H 75/22* (2006.01)

(52) U.S. Cl.
CPC ..... *B65H 75/2236* (2021.05)

(58) Field of Classification Search
CPC .. B65H 75/22; B65H 75/229; B65H 75/2218; B65H 75/2236; B65H 75/2245
See application file for complete search history.

(56) References Cited

U.S. PATENT DOCUMENTS

| | | | | | |
|---|---|---|---|---|---|
| 2,799,458 | A * | 7/1957 | Nye | G03B 21/321 | D8/358 |
| 3,817,475 | A * | 6/1974 | Goldstein | B65H 75/22 | 242/118.8 |
| 3,876,073 | A * | 4/1975 | Herbetko | B65H 75/14 | 206/400 |
| 3,958,775 | A * | 5/1976 | Liga | B65H 75/14 | D8/358 |
| 4,244,538 | A * | 1/1981 | Theros | B65H 75/14 | 242/118.8 |
| 5,203,516 | A * | 4/1993 | Donaldson | B65H 75/14 | 242/118.8 |
| 5,735,483 | A * | 4/1998 | Bierlein | B65H 75/22 | 242/118.8 |
| 5,791,590 | A * | 8/1998 | Zuk | B65H 75/22 | 242/610.6 |
| 8,480,024 | B2 | 7/2013 | Ries | | |
| 8,882,017 | B2 | 11/2014 | Woods | | |
| 10,549,944 | B2 * | 2/2020 | Ishikawa | B65H 75/14 | |

* cited by examiner

*Primary Examiner* — Sang K Kim
(74) *Attorney, Agent, or Firm* — LIPPES MATHIAS LLP

(57) ABSTRACT

A collapsible reel having a high strength to weight ratio is provided. The collapsible reel comprises a core, around which a flexible media is wound, and flanges which prevent the wound flexible media from migrating axially off the core. The core is formed of first and second blanks having core portions and a plurality of spaced apart arms or tabs projecting from the core portions.

13 Claims, 8 Drawing Sheets

COLLAPSIBLE/POP-UP REEL AND METHOD OF MAKING SAME

BACKGROUND

This application claims the priority benefit of U.S. provisional application Ser. No. 63/008,051, filed 10 Apr. 2020, the entire disclosure of which is expressly incorporated herein by reference, The present invention relates generally to reels for supporting or storing flexible media such as wire, cable, rope, or the like, and will be described with particular reference thereto. However, it is to be appreciated that the present invention is also amenable to other like applications.

Reels for supporting wound flexible media have been used for many years and are employed to both store and facilitate the dispensing of wound media such as rope, wire, electric cable, tubing, chain, strings of parts and the like. Conventionally, wooden reels or even composite wooden and metal reels have been used to store and dispense media. However, such reels have been expensive to manufacture, cannot be shipped in a knocked-down condition, or if so shipped, required extensive labor by the end user in order to erect them and were themselves substantially heavy. Once empty, the reels must be disposed of or returned for reuse. Disposal is generally not an environmentally viable option. Further, because the manufacture of these reels is expensive, disposal is not economically advantageous.

On the other hand, the return transportation of these reels present other problems. For instance, cable reels take up a considerable amount of space which imposes a limitation on the number of reels which can be loaded on a vehicle. As such, the transportation of empty cable reels can represent another significant cost. Thus, well-designed reels must combine a high strength to weight ratio with low manufacturing cost. The reels are preferably reusable and capable of disassembly or reduction in size when empty.

One reel design that has gained popularity for certain applications includes a collapsible reel in which the core is constructed of a pressed paperboard material and the flanges are constructed of a composite or plastic material. The use of paper and plastic components, in general, provides a high strength to weight ratio compared to wood and metal, is less expensive to transport and easier to manipulate, and facilitates the use of relatively straightforward manufacturing techniques. Moreover, paper products are generally easier to recycle. Another lightweight reel design consists of a pressed paperboard collapsible core and corrugated paper flanges.

Although attempts have been made to manufacture a collapsible, reusable reel, the prior art still has many disadvantages and drawbacks. For instance, many of the collapsible reels are too complicated and too expensive to manufacture. Other reels are not strong enough to withstand the loads of many media when reeled upon the core. Still other prior art constructions remain bulky and difficult to handle even when collapsed.

In light of the foregoing, it becomes evident that there is a need for a collapsible reel that would provide a solution to one or more of the deficiencies from which the prior art and/or conventional reels have suffered. It is still more clear that a collapsible reel providing a solution to one or more of the needs left by the prior art while providing a number of heretofore unrealized advantages thereover would represent an advance in the art. Accordingly, a need exists for a lightweight collapsible reel that has a high strength to weight ratio with low manufacturing cost.

Commonly owned U.S. Pat. No. 8,480,024 issued Jul. 9, 2013 and U.S. Pat. No. 8,882,017 issued Nov. 11, 2014 are examples of such a reel with a pop-up core, and the entire disclosures of each are expressly incorporated herein by reference. The general components of a reel include its core, around which the flexible media is wound, and flanges located at opposite ends or sides of the core that prevent the wound flexible media from migrating axially off of the core. Even then, these commonly owned disclosures can still encounter assembly issues that require specialized equipment and manipulation of the different components to create the final assembly—all of which adds cost and complexity to the machinery used to make and/or assemble the collapsible reels, and to the resultant reels.

A need exists for an improved arrangement that resolves at least one or more of the above-described deficiencies in known structures, as well as still other features and benefits.

SUMMARY

Disclosed herein is a new collapsible reel.

The reel preferably includes a core around which an associated flexible media is wound. The core has a first hub portion having a central region and a plurality of circumferentially spaced apart first arms or tabs of a first length projecting radially from the central region of the first hub portion, and a second hub portion having a central region and a like number of circumferentially spaced apart second arms or tabs of a second length less than the first length projecting radially from the central region of the second hub portion. Radially outer end portions of the second tabs of the first hub portion are secured to respective intermediate regions of the second tabs. First and second flanges are disposed at opposite ends of the core which prevent the wound flexible media from migrating off the core.

The first and second flanges are secured to the central regions of the first and second hub portions, respectively.

Each of the first tabs of the first hub portion includes a first pre-scored region that allows the first tab to bend relative to the central region of the first hub portion.

Each of the second tabs of the second hub portion includes a pre-scored region that allows the second tab to bend relative to the central region of the second hub portion.

The first pre-scored region of the first hub portion is located at an interface of each first tab with the central region of the first hub portion, and similarly the pre-scored region of the second hub portion is located at an interface of each second tab with the central region of the second hub portion.

Each of the first tabs of the first hub portion includes a second pre-scored region that allows a radially inner portion to bend relative to a radially outer portion of each first tab portion.

The second pre-scored regions allow the flanges to be selectively spaced from one another in a deployed position and advanced toward one another to collapse the reel.

A radial dimension between the first and second pre-scored regions of the first tabs defines the spacing of the flanges in the deployed position of the reel.

The core and flanges are preferably made from a corrugate material.

The central regions of the first and second hub portions are preferably adhesively secured to the first and second flanges, respectively.

Each of the first tabs of the first hub portion is adhesively secured to a respective second tab of the second hub portion.

At least one of the second tabs includes a locking member portion that cooperates with a locking member portion of one of the first and second flanges.

The first and second flanges are secured to the central regions of the first and second hub portions, respectively, and the locking member portion of the at least one second tab operatively engages the first flange and retains the flanges in the deployed position.

A primary benefit is a simpler assembly process.

Another advantage resides in the planar interconnection between the core portions in a collapsed state.

Benefits and advantages of the present disclosure will become more apparent from reading and understanding the following detailed description.

DETAILED DESCRIPTION

Figure 1:
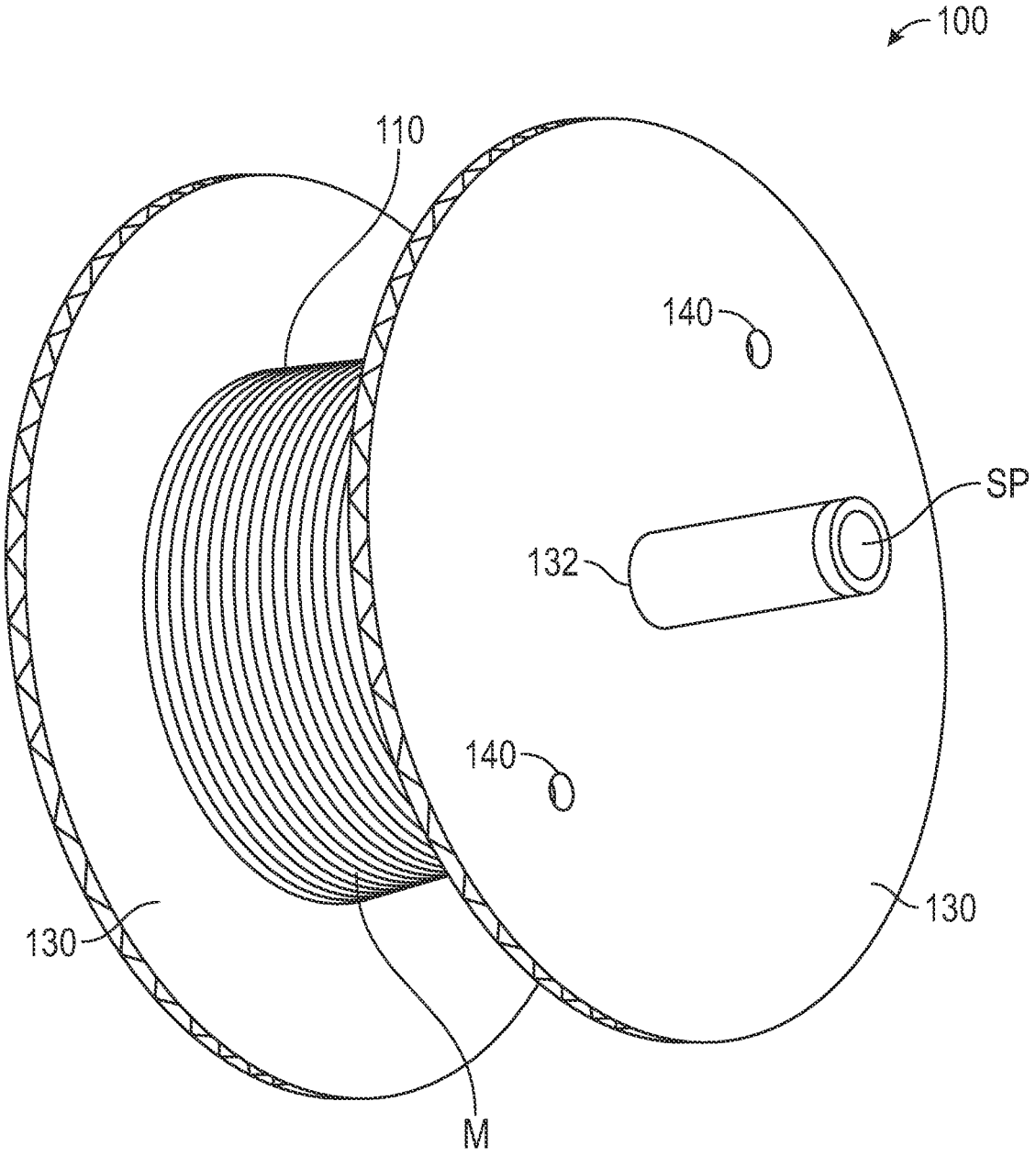
FIG. 1 is a perspective view of a collapsible reel of the present invention shown in a deployed or use configuration.

The following description with reference to the accompanying drawings is provided to assist in a comprehensive understanding of one or more embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. Various exemplary embodiments of the present disclosure are not limited to the specific details of different embodiments and should be construed as including all changes and/or equivalents or substitutes included in the ideas and technological scope of the appended claims. In describing the drawings, where possible similar reference numerals are used for similar elements.

The terms "include" or "may include" used in the present disclosure indicate the presence of disclosed corresponding functions, operations, elements, and the like, and do not limit additional one or more functions, operations, elements, and the like. In addition, it should be understood that the terms "include", "including", "have" or "having" used in the present disclosure are to indicate the presence of components, features, numbers, steps, operations, elements, parts, or a combination thereof described in the specification, and do not preclude the presence or addition of one or more other features, numbers, steps, operations, elements, parts, or a combination thereof.

The terms "or" or "at least one of A or/and B" used in the present disclosure include any and all combinations of words enumerated with them. For example, "A or B" or "at least one of A or/and B" mean including A, including B, or including both A and B.

Although the terms such as "first" and "second" used in the present disclosure may modify various elements of the different exemplary embodiments, these terms do not limit the corresponding elements. For example, these terms do not limit an order and/or importance of the corresponding elements, nor do these terms preclude additional elements (e.g., second, third, etc.) The terms may be used to distinguish one element from another element. For example, a first mechanical device and a second mechanical device all indicate mechanical devices and may indicate different types of mechanical devices or the same type of mechanical device. For example, a first element may be named a second element without departing from the scope of the various exemplary embodiments of the present disclosure, and similarly, a second element may be named a first element.

It will be understood that, when an element is mentioned as being "connected" or "coupled" to another element, the element may be directly connected or coupled to another element, and there may be an intervening element between the element and another element. To the contrary, it will be understood that, when an element is mentioned as being "directly connected" or "directly coupled" to another element, there is no intervening element between the element and another element.

The terms used in the various exemplary embodiments of the present disclosure are for the purpose of describing specific exemplary embodiments only and are not intended to limit various exemplary embodiments of the present disclosure. As used herein, the singular forms are intended to include the plural forms as well, unless the context clearly indicates otherwise.

All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having inconsistent or exaggerated meanings unless they are clearly defined in the various exemplary embodiments.

Figure 5:
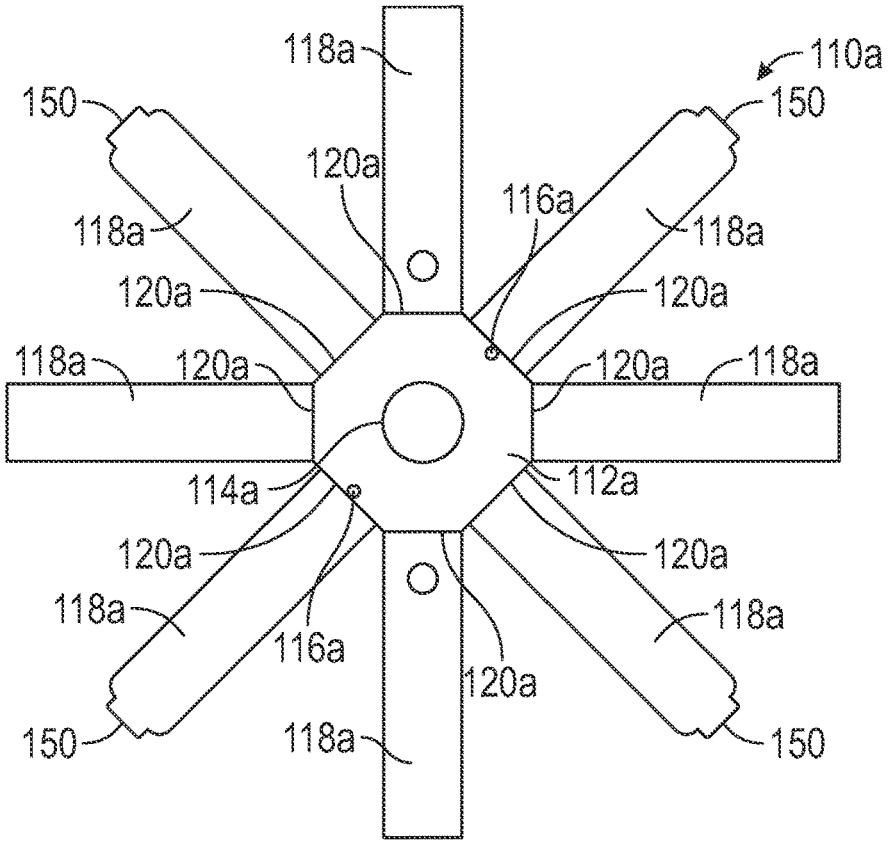
FIGS. 5 and 6 are plan views of separated first and second portions of the core structure similar to that shown is a unitary structure in FIG. 4.
Figure 6:
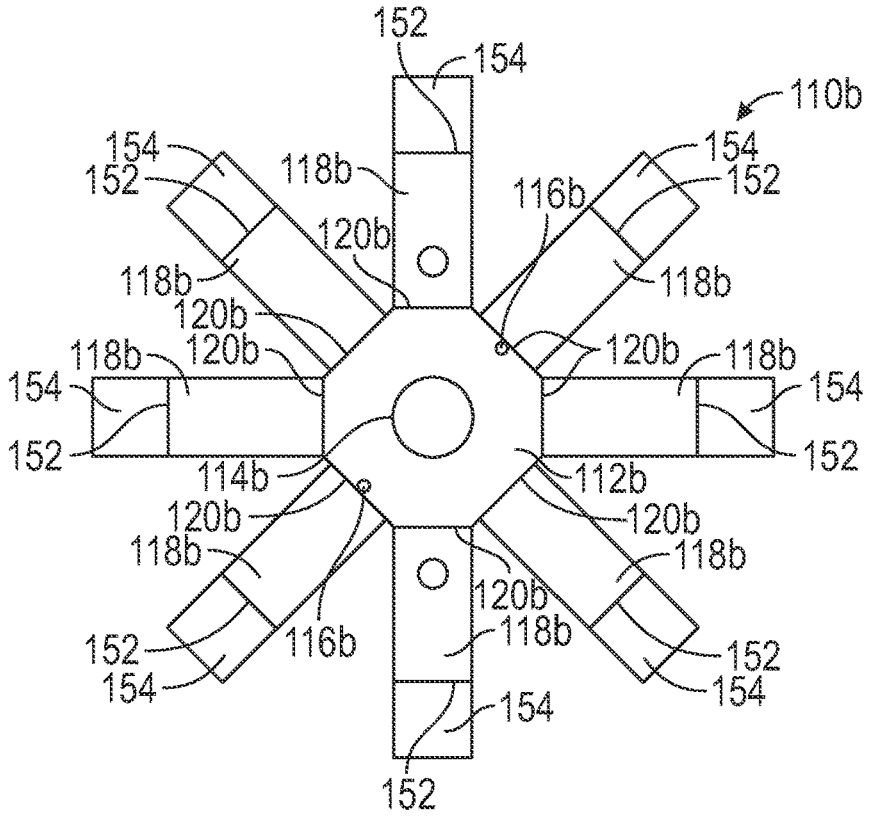
Figure 7:
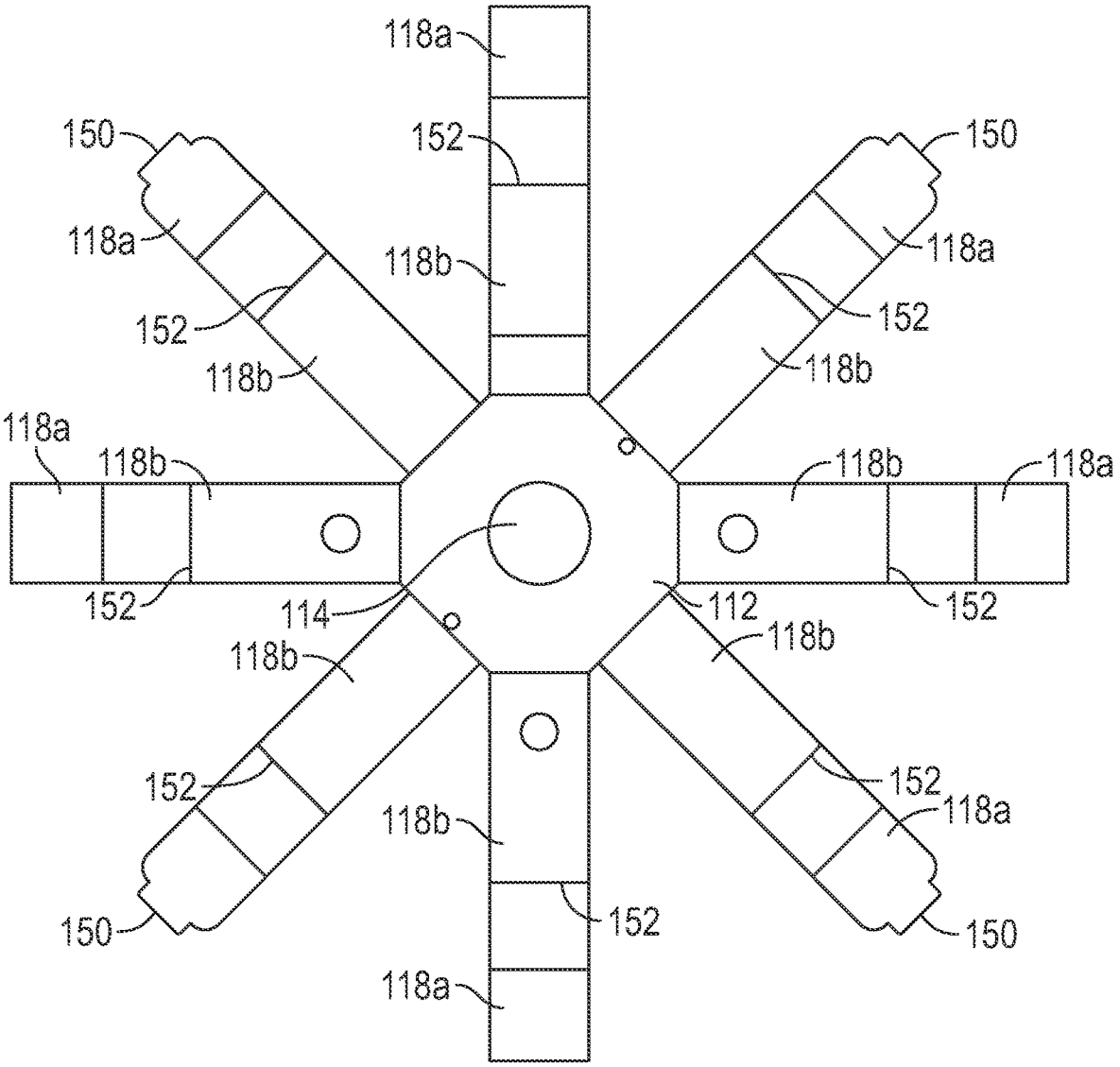
FIG. 7 is a plan view of the first and second portions of the core structure secured together in aligned, overlapping planar relation.
Figure 8:
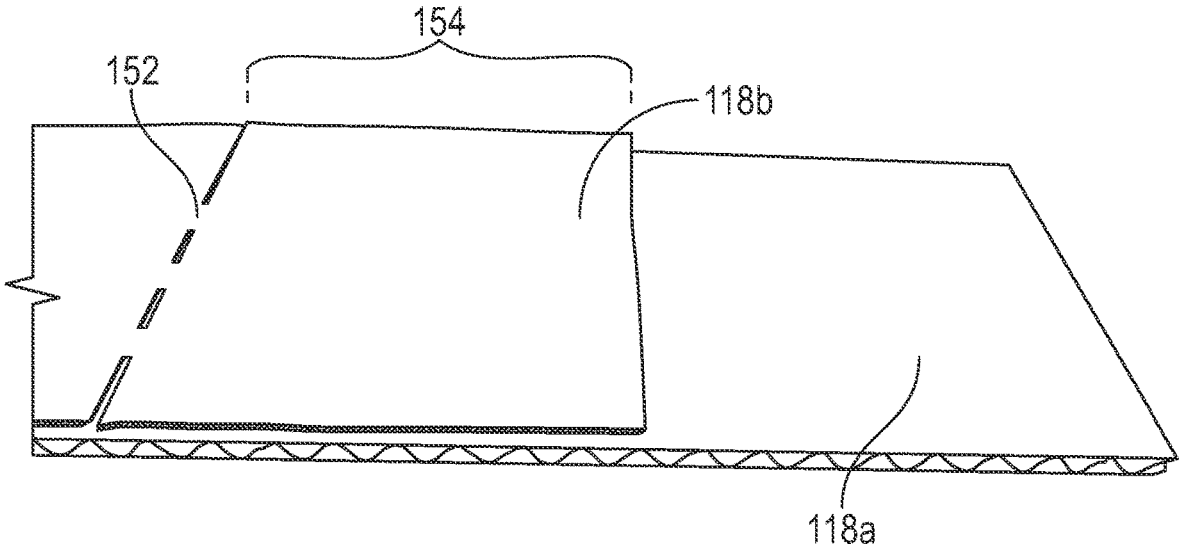
FIG. 8 is an enlarged perspective view of the ends of the first and second portions of the assembled core structure of FIG. 7.
Figure 9:
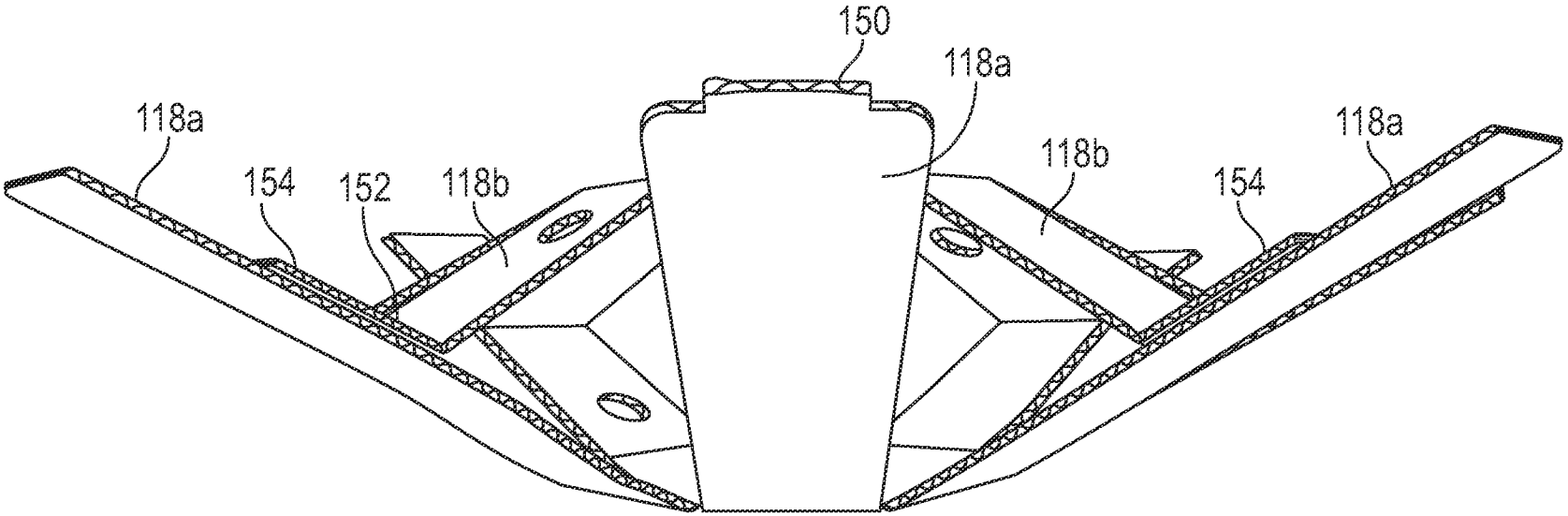
FIG. 9 is a partially folded or deployed core structure.

FIGS. 1-10 show a reel or reel assembly 100 having a collapsible hub or core 110. Sidewalls or flanges 130 are secured to opposite axial ends of the core 110, specifically central regions of the core portions are secured, e.g., adhesively secured, to inner surfaces of the sidewalls that face one another. In a collapsed state of the reel 100, the core 110 folds or collapses into a substantially planar configuration so that the sidewalls 130 adopt a minimum spacing therebetween, i.e., the sidewalls are closely adjacent and parallel to one another with the collapsed core sandwiched therebetween (FIGS. 7 and 8). The core 110 is reconfigured into an operative or deployed state where the spacing between the sidewalls 130 is increased. In the deployed state (FIGS. 1 and 10), the core 110 forms a generally cylindrical surface (e.g. octagonal-shaped surface) over which a media such as a flexible media M (e.g. wire, hose, cable, twine, etc.) is wound. The sidewalls 130 have a substantially greater perimeter dimension (e.g., diameter) than the diameter of the generally cylindrical assembled core 110 so that multiple layers of the flexible media M may be wrapped onto the core and continue to be wrapped onto the flexible media in layers around the core. The larger diameter of the sidewalls 130 relative to the smaller diameter of the core 110 axially constrains the flexible media M between the sidewalls.

A support shaft or spindle SP (FIG. 1) extends through the reel 100 and extends longitudinally through openings in the core 110 and sidewalls 130, extending outwardly in a generally orthogonal direction from the first and second sidewalls to support the reel for rotation about the shaft/spindle. In the illustrated arrangement of FIG. 1, each of the sidewalls 130 is preferably formed of a corrugated material having a single thickness, although it will be appreciated that if necessary multiple layers or thicknesses can be used to form the sidewall.

Figure 2:
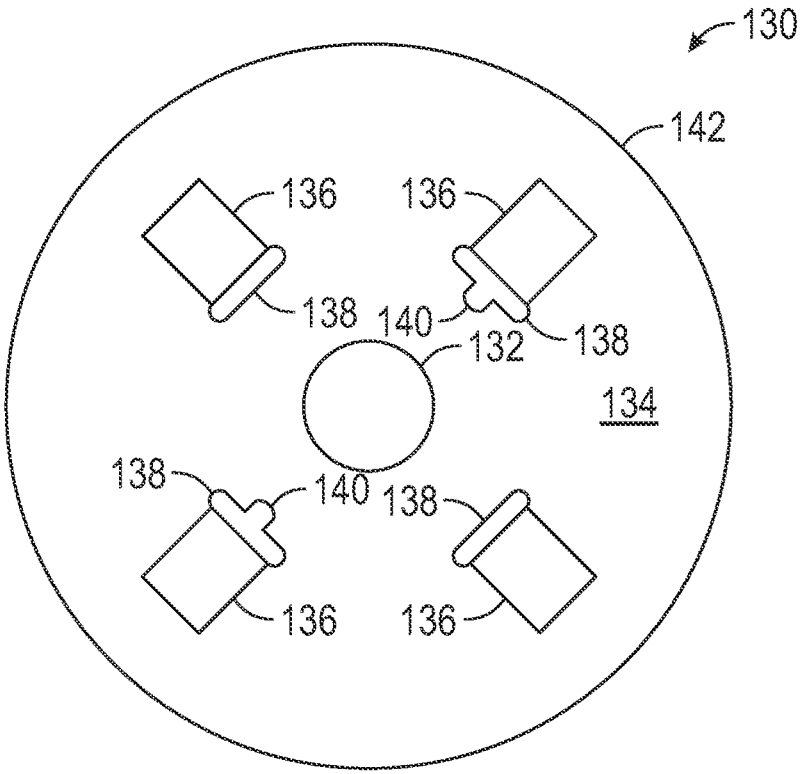
FIG. 2 illustrates a first or inner surface/face of a flange.
Figure 3:
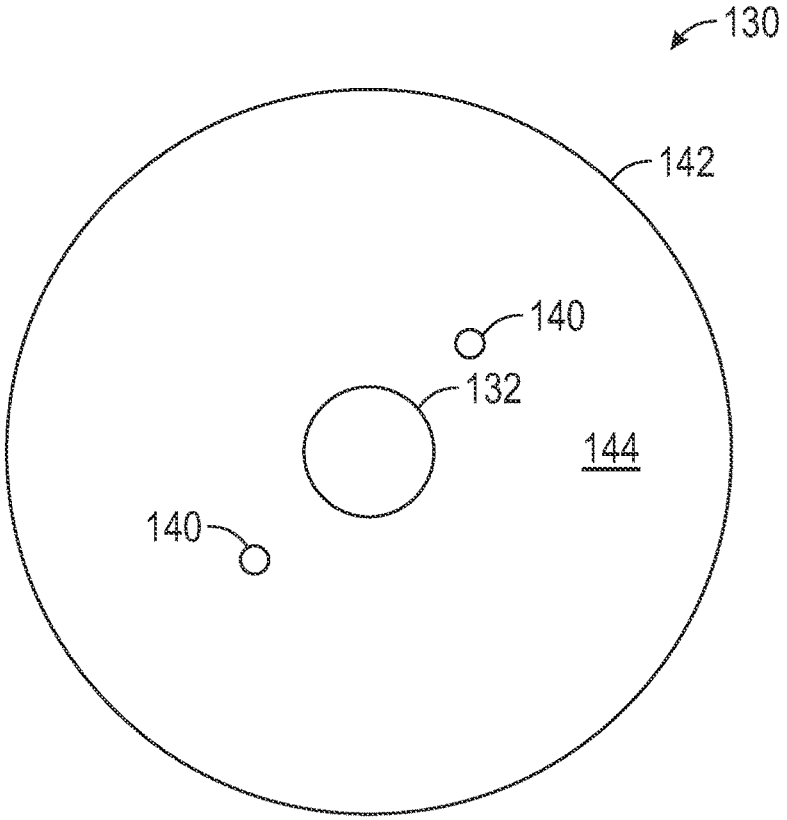
FIG. 3 shows a second outer surface/face of the flange of FIG. 2, it being understood that the completed reel assembly uses first and second flanges.

As shown in FIGS. 1-10, the collapsible reel 100 (core 110 and sidewalls 130) is preferably formed of foldable, form-retaining sheet material such as corrugated paper board with conventional, well-known equipment. For ease of manufacture, inventory, and for ease of assembly, sidewall 130 shown in FIGS. 2 and 3 is representative of either the first or second sidewall of the reel assembly 100, i.e., each sidewall has the same structural characteristics as the other sidewall so that description of one sidewall applies to the other unless specifically noted otherwise. The sidewall 130 desirably includes an opening 132 that extends through the sidewall and is preferably centered in the sidewall. The opening 132 is dimensioned for receipt over the spindle/shaft SP (FIG. 1) as described above to allow rotation of the reel 100 around the shaft. A first or inner face/interior surface 134 (FIG. 2) includes a locking assembly 136 shown here as including four distinct, circumferentially equispaced cutouts 138 that are dimensioned to receive a locking projection associated with select arms or tabs of a core portion (to be described further below). The number of cutouts need may vary, and cutouts 138 may extend partially through the sidewall 130 or could extend entirely through the sidewall without any adverse impact on the structure and operation of the reel assembly 100. A pair of smaller diameter openings 140 may also be provided through the sidewall 130 to facilitate orientation of the sidewalls during assembly of the reel 100, and/or may be used to rotate the reel assembly and store flexible media M on the core or for payout of the media from the reel assembly. As is also evident in FIG. 2, the openings 140 may be advantageously located to intersect with two of the cutouts 138 although that is not a necessity. An outer perimeter 142 of the sidewall 130 may adopt a circular conformation, although this preferred shape does not preclude other perimeter shapes (e.g. hexagonal, octagonal, etc.). An outer face or exterior surface 144 of the sidewall 130 is shown in FIG. 3.

Figure 4:
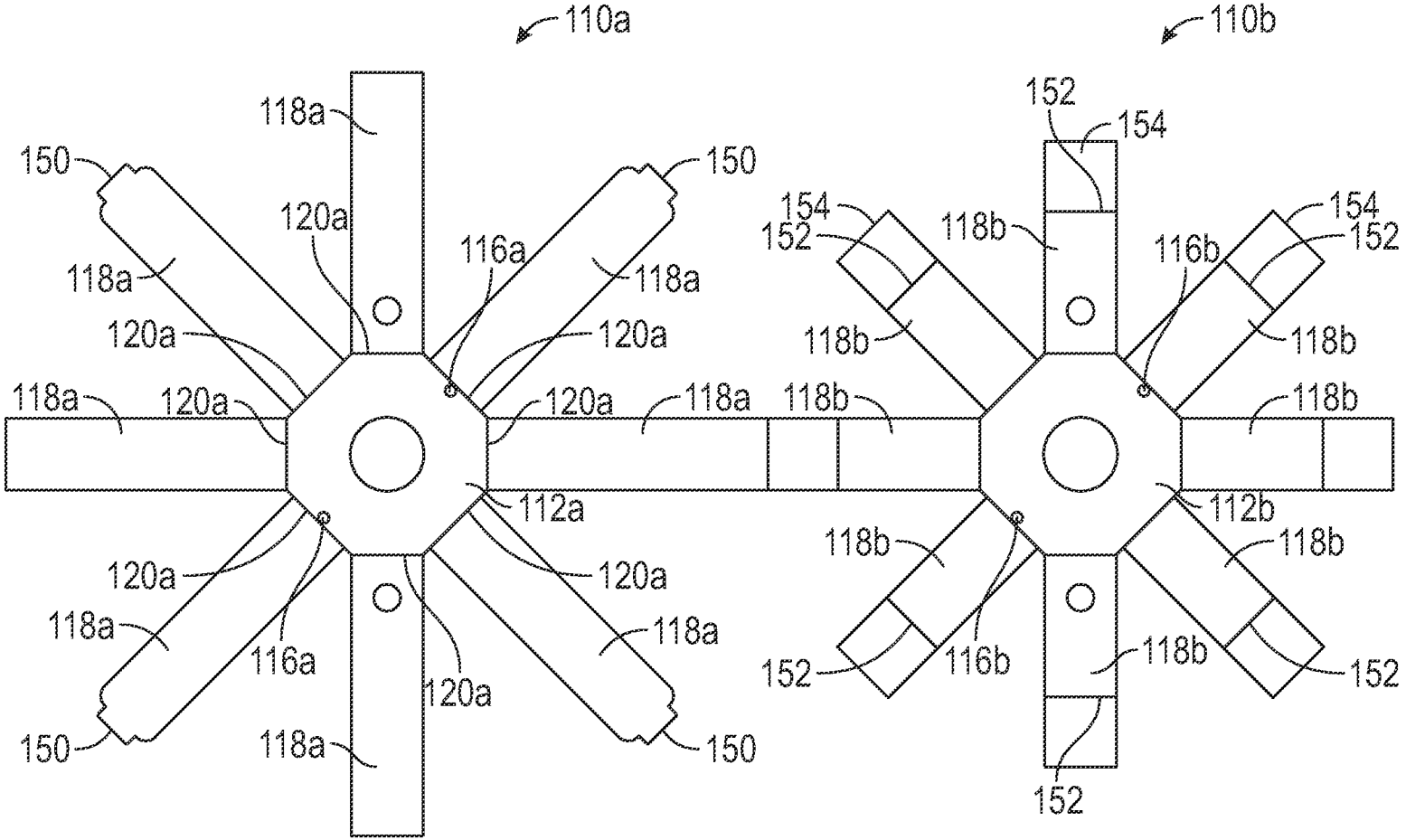
FIG. 4 is a plan view of a core structure.
Figure 10:
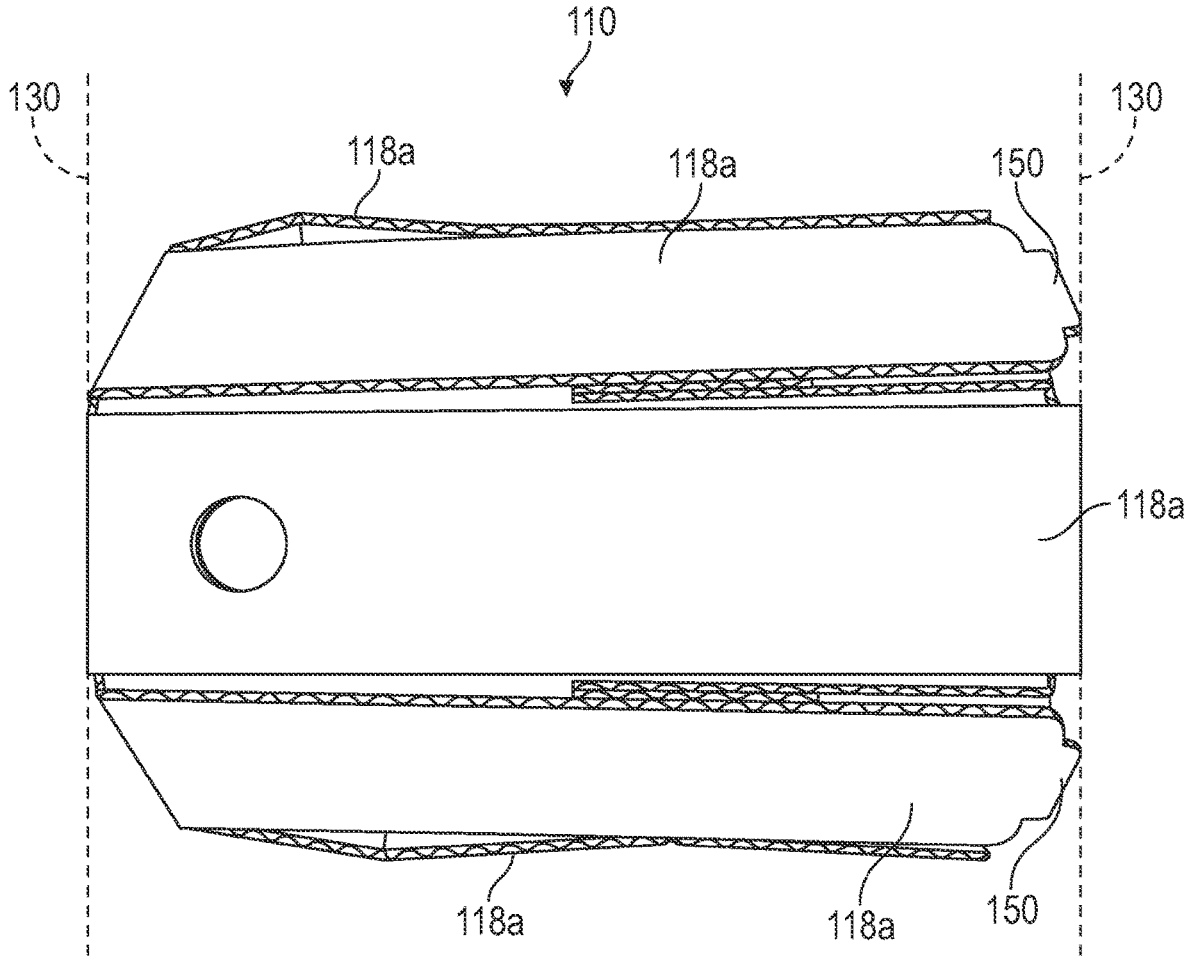
FIG. 10 is a completely folded or completely deployed core structure.

Turning next to FIGS. 4-6, there is shown a core in FIG. 4 as die-cut from a sheet or blank of corrugate material (not shown). In FIG. 4, first core portion 110*a* is joined to a second core portion 110*b*. As evident in FIGS. 5 and 6, the first and second core portions 110*a*, 110*b* are subsequently separated. Each core portion 110*a*, 110*b* includes a central region 112*a*, 112*b*, respectively, and in the preferred arrangement has an octagonal perimeter shape that is centered about a central opening 114*a*, 114*b* that is of substantially the same dimension as openings 132 in the sidewalls 130 in order to receive the shaft/spindle SP therethrough. Further, smaller diameter openings 116*a*, 116*b* are preferably located diametrically opposite one another at the outer perimeter of the central region and align with the openings 140 in the sidewalls 130. Each core portion 110*a*, 110*b* further includes a series of radially extending arms or tabs 118*a*, 118*b*, respectively. The tabs 118 preferably have a width that matches that of each straight edged portion of the octagonal perimeter, and the tabs preferably have a constant width over their entire radial extent for reasons which will become more apparent below. At the juncture of the tab 118 with the octagonal perimeter of the central region 112 of each core portion 110*a*, 110*b*, there is provided a score or fold region 120 (120*a*, 120*b*, respectively) that allows each tab to fold or bend relative to the central region. As will be appreciated, the tabs 118 bend through 90° between a flat, storage position (which is also the planar position for joining the first and second core portions together (FIGS. 7 and 8) through a partially deployed orientation shown in FIG. 9 to a fully deployed position shown in FIG. 10, and which is also the same position adopted in FIG. 1 where the tabs are adjacent one another such as shown in FIG. 10) and receive the flexible media M thereover. In FIG. 10, the sidewalls 130 are shown or represented in broken lines at opposite ends of the deployed core 110.

With reference again to FIGS. 5-8, a noticeable difference between core portions 110*a* and 110*b* relates to the length of the arms/tabs 118*a* and 118*b*. Specifically, the tabs 118*a* on the first core portion 110*a* have a greater dimension, i.e., are longer than the tabs 118*b* on the second core portion 110*b*. Each of the tabs 118*a* has substantially the same length although terminal ends of at least one of the tabs, and preferably four of the tabs, include a locking portion 150. In a preferred arrangement, the locking portions 150 are protrusions or extensions that have a slightly reduced width relative to the remainder of the respective tab 118*a* and are dimensioned for receipt in the corresponding cutouts 138 in one of the sidewalls 130. As perhaps best represented in FIG. 10, the locking portions 150 extend a slightly greater extent than the remaining tabs 118*a* of the first core portion and are then received in the cutouts 138 accessible from the inner face 134 of the sidewall 130.

The arms/tabs 118*b* of the second core portion 110*b* have a dimension (radial length) slightly less than the tabs 118*a* of the first core portion 110*a*. In addition, each of the tabs 118*b* includes a score or fold region 152 across the width of each of the tabs where the score is preferably located closer to the outer terminal ends than it is to the central region 112*b* of the second core portion 110*b*. With the tabs 118 located in the same plane as the central regions 112, i.e., in the collapsed state, the first core portion 110*a* is brought into abutting engagement with the second core portion 110*b* so that the central region and the tabs of one core portion overlie or are aligned with the central region and tabs of the other core portion. A region 154 of each tab 118*b* of the second core portion 110*b* disposed between the score 152 and the outer terminal end of each tab is secured (i.e. preferably adhesively secured) to a corresponding radial region of the tabs 118*a* of the first core portion 110*a* so that the first and second core portions are joined together. This is particularly illustrated in FIG. 8 where the tab 118*a* is shown as the lowermost layer, and the region 154 of the tab 118*b* forms a second or upper layer between score 152 and the terminal end thereof, and the region 154 is adhesively secured to the tab 118*a*. The remainder of the tab 118*b* i.e., that portion disposed radially inward of the score 152, is not secured to the corresponding tab 118*a* of the first core portion 110*a*. It is this arrangement that allows the core portions 110*a*, 110*b* to deploy (partially deployed in FIG. 9 and fully deployed in FIG. 10). Although the sidewalls 130 are removed from FIGS. 7-9 for ease of illustration, it will be evident to one skilled in the art that the central regions 112*a* and 112*b* are secured to the inner faces 134 of the respective sidewalls 130. Thus, when the central regions 112*a*, 112*b* and consequently the first and second sidewalls 130 are axially spaced from one another during deployment, the tabs 118*b* of the second core portion 110*b* fold as necessary along region 152 while tabs 118*a* of the first core portion 110*a* maintain their planar configuration during deployment. When locking portions 150 are aligned with the corresponding cutouts 138 on the inner face 134 of one of the sidewalls, the assembly in the deployed position is complete. Advancement of the locking portions 150 into the cutouts 138 maintains the spaced relation of the sidewalls as shown in FIGS. 1 and 10. Described another way, the axial spacing between the sidewalls is defined by the radial length of the tabs 118*a* of the first core portion 110*a*, and which becomes the length of the core 110 in the assembled reel 100. These locking arrangements enhance the stability of the assembled reel with simple mechanical locking features and still allow the collapsible reel to be unlocked and subsequently collapsed if desired.

As is evident from the foregoing, the collapsible reel may be economically manufactured substantially entirely of corrugated paper board, as indicated, and in addition, may be shipped in flattened condition, to thereby conserve shipping and storage space. The flanges are preferably constructed of a heavy-duty corrugated board having multiple layers corrugations, for additional strength, the corrugations of one layer being transverse to the corrugations of the other layer. It will also be appreciated that other materials of construction may be used while employing different features of the present disclosure. For example, instead of corrugate board, plastic or corrugate plastic may be used with other aspects of the collapsible reel or other recycled or recyclable materials may be used with equal success.

The description and drawings herein are merely illustrative and various modifications and changes can be made to the components and arrangement(s) of components without departing from the spirit of the invention. Like numerals refer to like parts throughout the several views.

The present invention has been described with reference to a preferred embodiment. Obviously, modifications and alterations will occur to others upon reading and understanding the preceding detailed description. It is intended that the present invention be construed as including all such modifications and alterations insofar as they come within the scope of the present invention.

This written description uses examples to describe the disclosure, including the best mode, and also to enable any person skilled in the art to make and use the disclosure. Other examples that occur to those skilled in the art are intended to be within the scope of the invention if they have structural elements that do not differ from the same concept or that do not differ from the literal language of the claims, or if they include equivalent structural elements with insubstantial differences from the same concept or from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

Although specific advantages have been enumerated above, various embodiments may include some, none, or all of the enumerated advantages. Although exemplary embodiments are illustrated in the figures and description herein, the principles of the present disclosure may be implemented using any number of techniques, whether currently known or not. Moreover, the operations of the systems and apparatuses disclosed herein may be performed by more, fewer, or other components, and the methods described herein may include more, fewer, or other steps. Additionally, steps may be performed in any suitable order.

To aid the Patent Office and any readers of this application and any resulting patent in interpreting the claims appended hereto, applicants do not intend any of the appended claims or claim elements to invoke 35 USC 112 (f) unless the words "means for" or "step for" are explicitly used in the particular claim.

What is claimed is:

1. A reel comprising:

a core, around which an associated flexible media is wound, the core having a first hub portion having a central region and a plurality of circumferentially spaced apart first tabs of a first length projecting radially from the central region of the first hub portion, each of the first tabs of the first hub portion includes a pre-scored region that allows the first tab to bend relative to the central region of the first hub portion, and a second hub portion having a central region and a same number of second tabs as the plurality of first tabs, the second tabs circumferentially spaced apart and each having a second length less than the first length of the corresponding first tabs and the second tabs projecting radially from the central region of the second hub portion, radially outer end portions of the second tabs of the second hub portion secured to respective intermediate regions located radially inward of terminal ends of the first tabs, wherein outer terminal end portions of the second tabs are secured to the first tabs such that outer terminal end portions of each respective first tab extends radially outward further than the outer terminal end portion of the second tabs, and intermediate regions located radially inward of terminal ends of the second tabs form a layer between the first tabs of the first hub and the second tabs of the second hub when the reel is in a deployed position, each of the second tabs of the second hub portion includes a first pre-scored region that allows the second tab to bend relative to the central region of the second hub portion, and each of the second tabs of the second hub portion includes a second pre-scored region that allows a radially inner portion to bend relative to a radially outer portion of each second tab portion; and first and second flanges disposed at opposite ends of the core which prevent the wound flexible media from migrating off the core.

2. The reel of claim 1 wherein the first and second flanges are secured to the central regions of the first and second hub portions, respectively.

3. The reel of claim 1 wherein the pre-scored region of the first hub portion is located at an interface of each first tab with the central region of the first hub portion.

4. The reel of claim 3 wherein the first pre-scored region of the second hub portion is located at an interface of each second tab with the central region of the second hub portion.

5. The reel of claim 1 wherein the second pre-scored regions allow the flanges to be selectively spaced from one another in a deployed position and advanced toward one another to collapse the reel.

6. The reel of claim 5 wherein a radial dimension between the first and second pre-scored regions of the second tabs defines the spacing of the flanges in the deployed position of the reel.

7. The reel of claim 1 wherein the core and flanges are made from a corrugate material.

8. The reel of claim 1 wherein the central regions of the first and second hub portions are adhesively secured to the first and second flanges, respectively.

9. The reel of claim 1 wherein each of the first tabs of the first hub portion is adhesively secured to a respective second tab of the second hub portion.

10. The reel of claim 1 wherein at least one of the first tabs includes a locking member portion that cooperates with a locking member portion of one of the first and second flanges.

11. The reel of claim 10 wherein the first and second flanges are secured to the central regions of the first and second hub portions, respectively, and the locking member portion of the at least one first tab operatively engages the first flange and retains the flanges in the deployed position.

12. A method of assembling a collapsible reel comprising:

providing first and second hub portions wherein the first hub portion has first tabs, each of the first tabs of the first hub portion includes a pre-scored region that allows the first tab to bend relative to the central region of the first hub portion, and the second hub portion has second tabs, each of the second tabs of the second hub portion includes a first pre-scored region that allows the second tab to bend relative to the central region of the second hub portion, and each of the second tabs of the second hub portion includes a second pre-scored region that allows a radially inner portion to bend relative to a radially outer portion of each second tab portion, and each of the first tabs is longer than each of the second tabs, securing the second tabs of the second hub portion to respective first tabs of the first hub portion wherein outer terminal ends of the second tabs are located radially inward from outer terminal ends of the first tabs when the first and second tabs are secured together, and intermediate regions located radially inward of terminal ends of the second tabs form a layer between the first tabs of the first hub and the second tabs of the second hub when the reel is in a deployed position;

securing first and second flanges to the first and second hub portions, respectively;

pulling the first and second flanges apart to form a core with the first and second tabs interposed between the flanges.

13. The method of claim 12 further comprising locking the flanges in spaced relation.

* * * * *